US006663017B2

(12) United States Patent
Endres et al.

(10) Patent No.: US 6,663,017 B2
(45) Date of Patent: Dec. 16, 2003

(54) DEVICE FOR GENERATING A PRESSURIZED STREAM OF TREATING MEDIA

(75) Inventors: Michael Endres, Woodridge, IL (US); Rudy Publ, Glendale Heights, IL (US)

(73) Assignee: Safety-Kleen Systems, Inc., Plano, TX (US)

( * ) Notice: Subject to any disclaimer, the term of this patent is extended or adjusted under 35 U.S.C. 154(b) by 0 days.

(21) Appl. No.: 10/182,000

(22) PCT Filed: Jan. 25, 2001

(86) PCT No.: PCT/US01/02349

§ 371 (c)(1),
(2), (4) Date: Jul. 24, 2002

(87) PCT Pub. No.: WO01/58598

PCT Pub. Date: Aug. 16, 2001

(65) Prior Publication Data

US 2003/0001026 A1 Jan. 2, 2003

Related U.S. Application Data

(60) Provisional application No. 60/178,617, filed on Jan. 28, 2000.

(51) Int. Cl.[7] ..... B05B 7/26

(52) U.S. Cl. ..... 239/311; 239/337; 239/340; 239/347; 239/348; 239/365; 239/373; 169/30; 169/71; 169/85

(58) Field of Search ..... 239/311, 337, 239/364, 365, 366, 367, 368, 369, 340, 346, 347, 348, 372, 373; 169/30, 71, 85

(56) References Cited

U.S. PATENT DOCUMENTS

| | | | | | |
|---|---|---|---|---|---|
| 281,942 | A | * | 7/1883 | Sutton | 239/372 |
| 495,249 | A | * | 4/1893 | Hugershoff | 239/373 |
| 2,620,038 | A | * | 12/1952 | Somers et al. | 169/85 |
| 2,745,700 | A | * | 5/1956 | Phalen | 239/366 |
| 3,704,811 | A | * | 12/1972 | Harden, Jr. | 239/367 |
| 4,318,443 | A | * | 3/1982 | Cummins | 239/366 |
| 4,515,310 | A | * | 5/1985 | Hengesbach | 239/366 |

* cited by examiner

*Primary Examiner*—Robin O. Evans
(74) *Attorney, Agent, or Firm*—Vedder Price Kaufman & Kammholz

(57) ABSTRACT

A device for generating a pressurized stream of treating media including a vessel (4) containing the treating media (6), a pressurized fluid delivery assembly (16) for delivering a pressurized fluid to the vessel (4) and a conduit (14) for transporting the treating media (6) out of the vessel (4) which has been pressurized through the pressurized fluid.

14 Claims, 3 Drawing Sheets

DEVICE FOR GENERATING A PRESSURIZED STREAM OF TREATING MEDIA

RELATED APPLICATION

This application claims the priority benefits of U.S. Provisional Patent Application Ser. No. 60/178,617 filed Jan. 28, 2000.

FIELD OF THE INVENTION

The present invention is generally directed to a device for generating a stream of solid particulate matter or liquid which is provided at sufficient pressure and velocity so that it can remove solid debris, difficult stains and other unwanted materials (e.g. glues, adhesives, etc.). The device can be constructed on a large scale for and removal of unwanted materials from large objects such as platforms, floors and the like. The device can also be constructed on a small scale wherein the substrate may be as small as a large size coin.

BACKGROUND OF THE INVENTION

Devices for generating a stream of pressurized particulate matter such as sand blasters are known in the art. Such devices employ solid particulate matter (e.g. sand) which has been accelerated by a pressurized gas or liquid to provide a pressurized stream which can be directed at a substrate.

Such devices are successful in generating a pressurized stream of solid particulate matter. However, they suffer from a number of disadvantages including a lack of control of the substrate damage due to the pressurized stream and problems with cleaning up the solid particulate matter.

Most devices employ an abrasive material as the solid particulate matter such as sand, glass beads, and plastic beads. Most of the solid abrasive materials customarily employed are difficult to dispose of after use and/or present environmental problems. This is because the solid particles must be collected or swept from the area around the substrate and properly disposed of. This requires significant cost and in some cases the solid particulate matter comes under environmental scrutiny leading to waste disposal problems.

For those devices which employ non-abrasive materials, they are disadvantageous because they do not provide the combination of manageable size and control of the pressurized stream and/or are not easily connected to a single fluid source through conventional fluid supplying and pressurizing equipment.

It would therefore be a significant advance in the art of treating substrates with a pressurized stream of a treating media in the form of a solid particulate matter, liquid or mixtures thereof if sufficient control can be provided to the stream by controlling the rate and pattern of flow of the treating media.

It would be a further advance in the art if the treating media was safe and effective to use and could be easily disposed of without raising environmental concerns.

SUMMARY OF THE INVENTION

The present invention is generally directed to a device for generating a pressurized stream of a treating media in the form of solid particulate matter, liquid or mixture thereof in which a pressurized fluid (i.e. gas, liquid or combination thereof) and the treating media are combined in a manner which produces a controllable stream. In a further aspect of the present invention, the treating media in the form of solid particulate matter, liquid or mixture thereof is comprised of a compound or mixture of compounds which can be easily disposed of by washing the substrate and surrounding area with an environmentally acceptable liquid (e.g. water).

In a particular aspect of the present invention there is provided a device for generating a pressurized stream of a treating media selected from the group consisting of solid particulate matter, liquid and mixtures thereof comprising:

a) a vessel for housing the treating media up to an upper level;

b) pressurized fluid delivery means for delivering pressurized fluid to the vessel above the upper level of the treating media contained within the vessel; and c) a first conduit for transporting the pressurized treating media out of the vessel including an open end lying below the upper level of the treating media for receiving the treating media when pressurized by the pressurized fluid within the vessel, an opening positioned above the upper level of the treating media for receiving a portion of the pressurized fluid, and an opposed end for delivering the pressurized stream of the treating media.

In a preferred form of the present invention, the treating media is comprised of solid particulate matter and most preferably one or more water soluble bicarbonate or carbonate compounds which facilitate removal from the substrate by an environmentally acceptable liquid such as water because the same are soluble therein.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is generally directed to a device for generating a pressurized stream of a treating media employing a vessel for combining the treating media and a pressurized fluid stream, a pressurized fluid delivery assembly for delivering the pressurized fluid to the vessel and a conduit for transporting the pressurized treating media out of the vessel and towards a substrate for cleaning or other similar purpose.

As used herein the term "treating media" shall mean any solid particulate matter or any liquid or mixtures thereof which can be pressurized and delivered towards a substrate for cleaning or other purposes. Examples of solid particulate matter include, but are not limited to, bicarbonates, carbonates, oxides, silicas, plastic materials, glass beads and the like. Examples of liquids include, but are not limited to, surfactants, detergents, solvents and the like.

Figure 1:
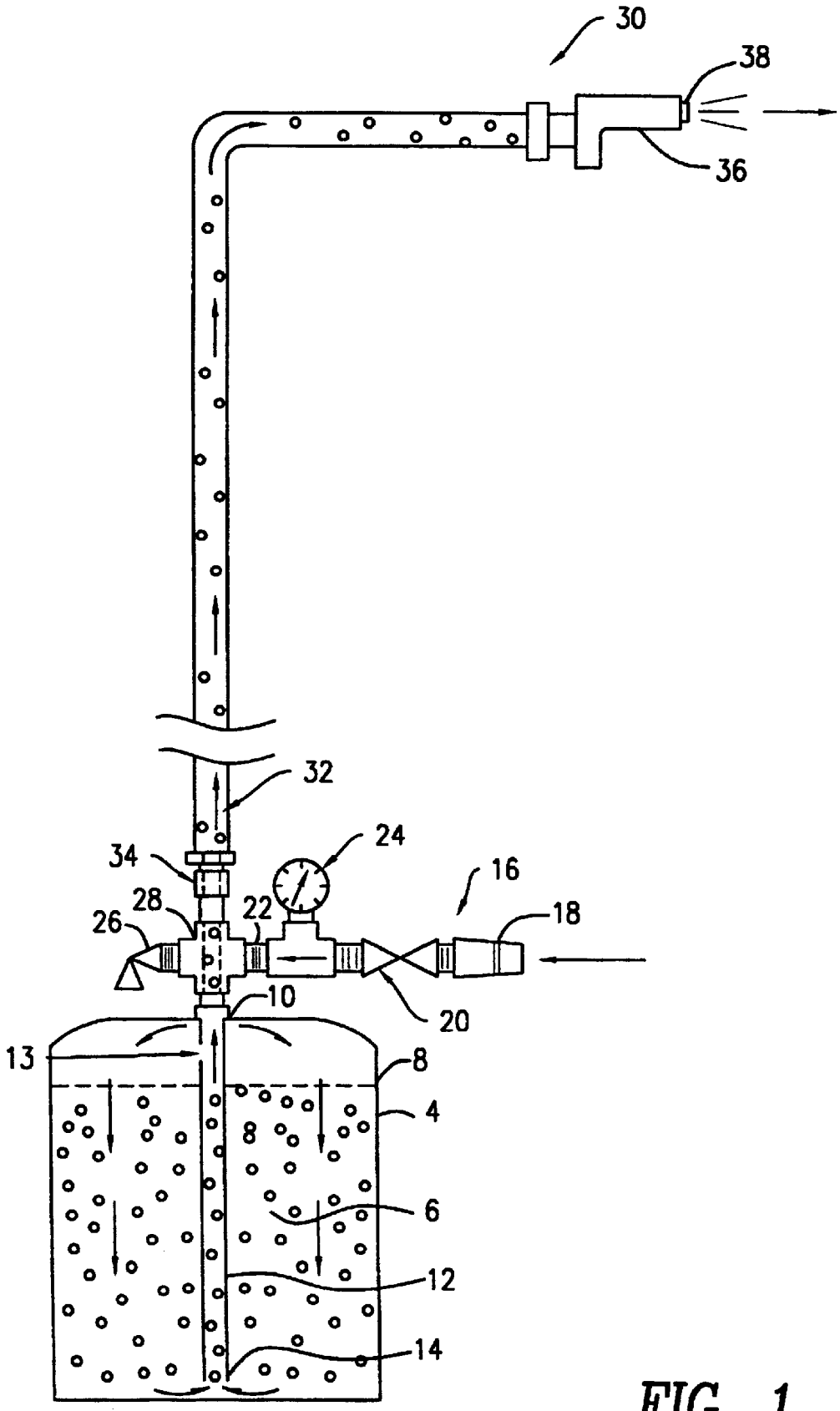
FIG. 1 is a side view in partial cross-section of an embodiment of the device in accordance with the present invention.

Referring to FIG. 1, there is shown an embodiment of a device 2 in accordance with the present invention for delivering a pressurized stream of treating media. By way of example only, the treating media will be hereinafter described with regard to the drawing figures as "solid particulate matter". The device 2 includes a vessel 4 which is loaded with the solid particulate matter 6 up to an upper level 8. An opening 10 is provided at the top of the vessel 4 enabling a conduit 12 to extend into the vessel 4 toward the bottom end thereof. The conduit 12 has an opening 14 which, as explained hereinafter, provides an entry for pressurized solid particulate matter to enter the conduit.

The conduit 12 extends out of the vessel 4 where it is in operable connection with a fluid delivery assembly 16. As used herein, the term "fluid" is intended to cover gases, liquids and combinations thereof. The fluid delivery assembly 16 includes a source of compressed fluid (not shown) which may be within or without the device which plugs into a connecting assembly 18 including optionally a water vapor trap 17 for removing water from the pressurized fluid, (see FIG. 2) a shut-off valve 20, and a conduit 22 which may include a pressure gauge 24 to monitor the pressure of the pressurized fluid. A pressure release valve 26 may be provided to prevent against over pressurization the device 2 including the conduit 12 and the vessel 4. The pressure release valve 26 may be located at any point which is in contact with the pressurized fluid emanating from the source thereof.

The conduit 22 of the connecting assembly 18 is operatively connected to a manifold 28 which provides the opportunity for the pressurized fluid to be delivered to the vessel 4 and in a particular embodiment of the invention to provide a separate stream of pressurized fluid upward through the conduit 12 which extends out of the vessel 4.

In the particular aspect of the present invention shown in FIG. 1, the conduit 12 receives pressurized fluid from the fluid delivery assembly 16 which enters the top end of the vessel 4. The pressurized fluid exerts pressure on and mixes with the solid particulate matter 6 to provide a pressurized stream of solid particulate matter for entry into the opening 14 of the conduit 12. At the same time, a separate stream of pressurized fluid enters the conduit 12 at a point above the upper level 8 of the solid particulate matter through an opening within the conduit 12. As shown specifically in FIG. 1, the opening 13 is positioned within the conduit 12 at a point within the vessel 4. The pressurized fluid enters the opening 13 and thereby creates a pressure differential which draws the pressurized solid particulate matter entering the opening 14 upward through the conduit 12 so that it may proceed to a pressurized stream of solid particulate matter delivery system hereinafter designated by numeral 30.

Figure 2:
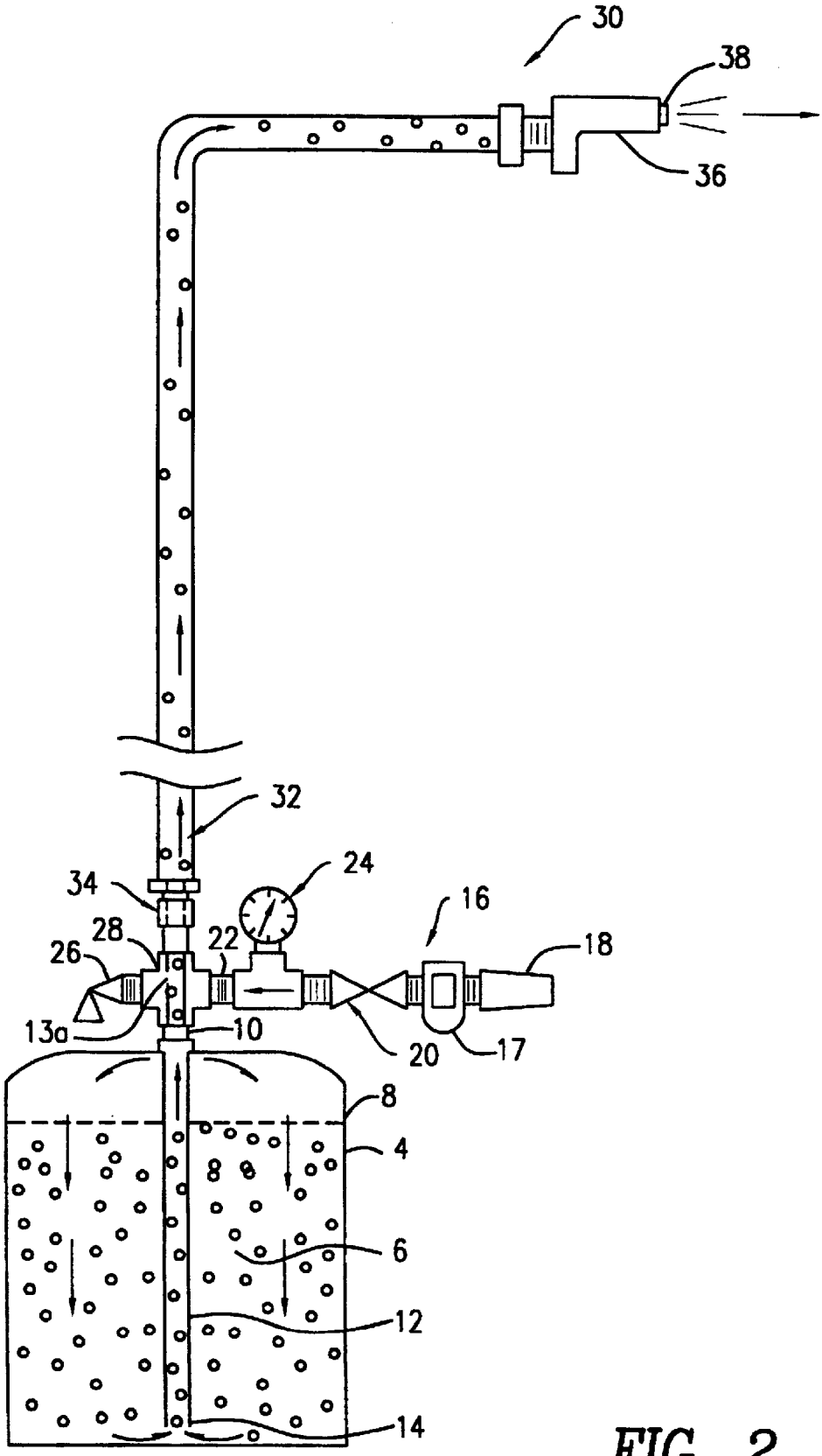
FIG. 2 is a side view in partial cross-section of another embodiment of the pressurized fluid delivery assembly for generating pressurized fluid to mix with the treating media.
Figure 3:
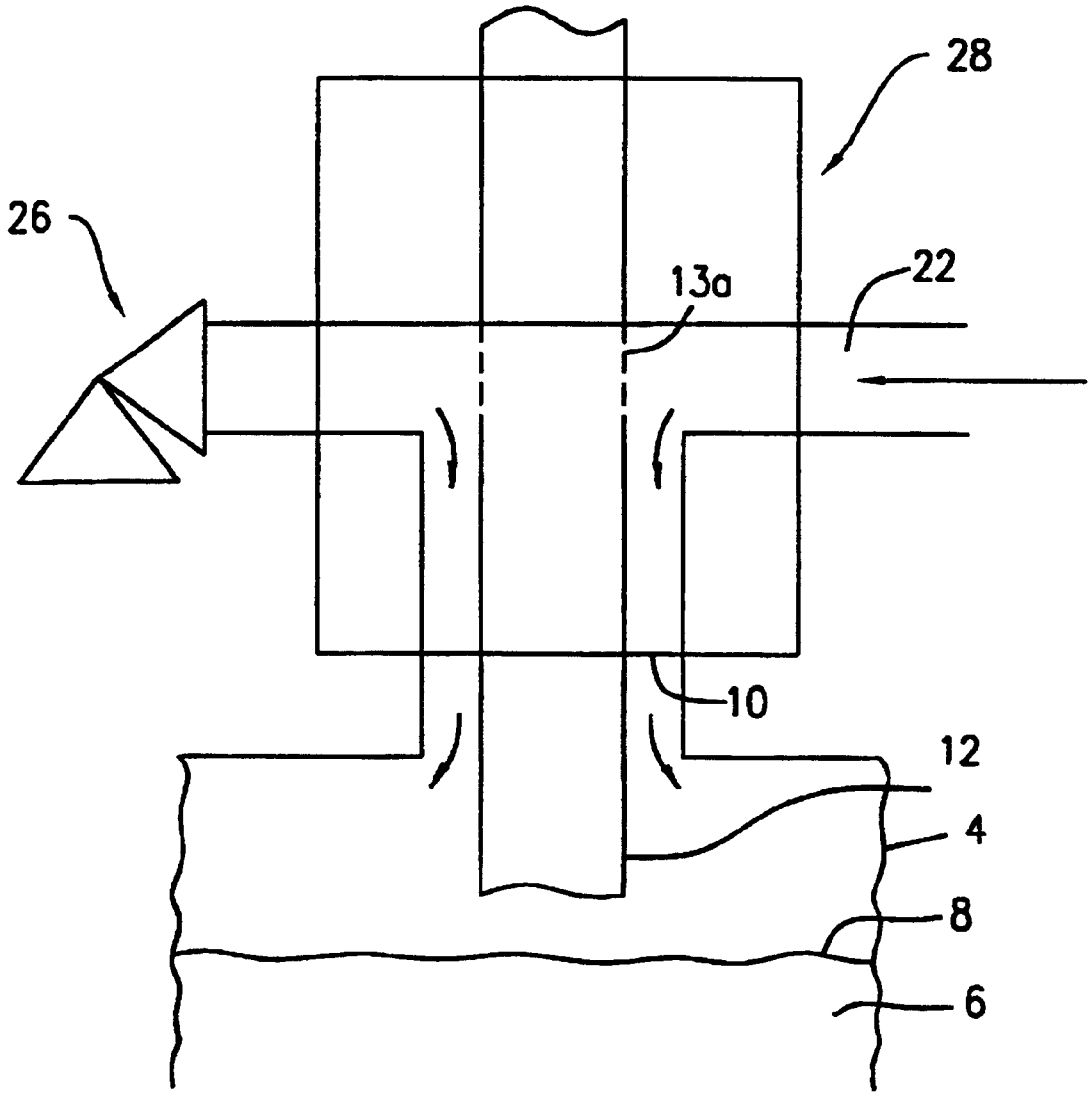
FIG. 3 is a cross-sectional view of an embodiment of a manifold employed in an embodiment of the present invention.

In an alternative aspect of the present invention as shown specifically in FIGS. 2 and 3, the pressurized fluid enters an opening 13*a* at a point outside the vessel 4. In this embodiment of the invention, the pressurized fluid stream from the fluid delivery assembly 16 may be branched so that a portion of the pressurized fluid goes down into the vessel 4 as previously explained and another portion enters the opening 13*a* to create the pressure differential as previously described. The opening 13*a* may typically be at the junction of the conduits 22 and 12 or in close proximity thereto.

The opening 13 or 13*a* which provides access to the conduit 12 of the pressurized fluid should be of sufficient size to enable a sufficient amount of pressurized fluid to enter the conduit and create a sufficient pressure differential so as to assist in drawing the pressurized solid particulate stream upward through the conduit 12. The size of the opening may vary depending on the size of the conduit. In general, the ratio of the size of the opening and the internal dimension of the conduit (e.g. diameter) is from about 1:1 to 1:20, preferably at or about 1:10. By way of example, a conduit having a diameter of 0.25 inch would suitably have an opening 13 or 13*a* measuring about 0.25 inch. As previously indicated, the size and shape of the opening 13 or 13*a* may vary so long as a sufficient pressure differential is created to assist in drawing the pressurized treating media stream such as a pressurized solid particulate matter stream through the delivery system 30. Alternatively, a bypass valve assembly incorporating a fluid control device such as a ball valve or needle valve may be used to provide a pressurized fluid stream from the conduit 22 to the conduit 12 at a location within the manifold 28.

Referring again to FIG. 1, the solid particulate matter delivery system 30 includes an extension of the conduit 12 or a second conduit 32 connected to the first conduit 12 through a connector 34. Such connectors are well known in the art. The second conduit is provided at an end 36 opposed from the connected end with an opening 38 which may deliver the pressurized solid particulate matter to a substrate. In a preferred embodiment of the invention as specifically shown in FIG. 1, there is provided a nozzle assembly 36 which provides for the controlled release of the pressurized stream of solid particulate matter from the device 2. The nozzle 36 has at least one opening 38 for emitting the pressurized particulate matter. The nozzle 36 may be provided with multiple openings 38 to provide larger coverage of the targeted substrate. It will be understood that the size of the opening or openings 38 may be routinely adjusted depending on whether the treating media is a solid particulate matter, a liquid or mixtures thereof.

In a preferred form of the invention, the treating media is solid particulate matter 6 and is principally made of water soluble compounds such as bicarbonates (e.g. sodium and calcium bicarbonates) or carbonates (e.g. calcium carbonate) so that they can be readily dissolved and washed away in the clean up operation. This provides distinct advantages over prior art systems which employ non-soluble solid particulate matter (e.g. sand) which provides more difficult clean up. Bicarbonates and carbonates also provide advantages oversolid particulate matter materials (e.g. water soluble, easy waste disposal, non-toxic, non-substrate damaging) which present environmental concerns.

The vessel 4 is typically made of materials which can withstand pressurization typically up to and exceeding 300 psi. In most cases, for moderate sized cleaning operations, a vessel rated to 120 psi is acceptable. The vessel can be made of a variety of plastic and metal materials. For long term use, steel is the preferred material of construction because of its long term resistance to abrasion. Plastics are the preferred materials for short term or disposable units because they are relatively inexpensive to produce.

The conduit 12 employed within the vessel 4 is preferably made of a rigid plastic or metal material. The preferred materials are the same as those that may be used to construct the vessel. The conduit 32, as previously indicated, may merely be an extension of the conduit 12. In a preferred form of the invention, the conduit 32 is made of a flexible materials that are appropriately pressure rated and desirably abrasive resistant (for long term use) such as rubbers, rubber composites, polypropylene, polyethylene, and combinations thereof.

The operation of the device of the present invention is as follows. Pressurized fluid is applied to the device by opening the pressure shut off valve 20. It will be understood that the source of the pressurized fluid may be contained within or without the device. Pressurized fluid then enters the vessel 4 through the opening 10 therein to provide pressurized treating media such as solid particulate matter which enters the opening 14 of the conduit 12. At the same time pressurized fluid enters the conduit 12 at the opening 13 or 13*a* to assist in drawing the pressurized particulate matter through the conduits 12 and 32 and out the opening 38 of the delivery system 30. Preferably there is provided a nozzle 36 to assist in controlling the release of the pressurized stream of the treating media.

The device of the present invention may be used in conjunction with a protective device over at least the nozzle to minimize the area over which the treating media is sprayed during cleaning.

What is claimed is:

1. A device for generating a pressurized stream of treating media comprising: a) a vessel for housing the treating media up to an upper level; b) pressurized fluid delivery assembly for delivering pressurized fluid to said vessel above the upper level of the treating media, said pressurized fluid delivery assembly including water vapor removing means for removing water vapor from the pressurized fluid; and c) a first conduit for transporting said pressurized treating media out of the vessel comprising an open end lying below the upper level of the treating media for receiving the treating media when pressurized by the pressurized fluid within the vessel, an opening positioned above the upper level of the treating media for receiving a portion of the pressurized fluid, and an opposed end for delivering the stream of the treating media.

2. The device of claim 1 wherein the media is selected from the group consisting of solid particulate matter, liquid and mixtures thereof.

3. The device of claim 1 wherein the treating media is solid particulate matter.

4. The device of claim 1 further comprising a nozzle at the opposed end of the conduit for generating a controlled release of the pressurized stream of the treating media.

5. The device of claim 1 wherein the size and shape of the conduit and opening and the pressure of the pressurized fluid are selected to generate the pressurized stream of treating media with sufficient force and velocity to clean a substrate.

6. The device of claim 5 wherein the ratio of the size of the opening and the size of the conduit is from about 1:1 to 1:20.

7. The device of claim 6 wherein the ratio is about or equal to 1:10.

8. The device of claim 1 wherein the opening is positioned outside of the vessel.

9. The device of claim 1 wherein the pressurized fluid delivery assembly comprises: a) an inlet for receiving a pressurized fluid; b) a second conduit for transporting the pressurized fluid from the inlet to the first conduit.

10. The device of claim 9 wherein the opening is at the junction of the first and second conduits.

11. The device of claim 2 wherein the nozzle comprises a plurality of openings for passing the pressurized stream of treating media out of the first conduit.

12. The device of claim 3 wherein the solid particulate matter is selected from bicarbonates, carbonates, oxides, silicas, plastic materials, glass beads, and mixtures thereof.

13. The device of claim 1 wherein the pressurized fluid is a liquid.

14. The device of claim 1 wherein the pressurized fluid is a pressurized gas.

* * * * *